US006698955B2

(12) United States Patent
Ozawa

(10) Patent No.: US 6,698,955 B2
(45) Date of Patent: Mar. 2, 2004

(54) METHOD AND APPARATUS FOR ADJUSTING PRINT POSITIONS OF DOT LINE PRINTER

(75) Inventor: Hideaki Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 178 days.

(21) Appl. No.: 09/822,199

(22) Filed: Apr. 2, 2001

(65) Prior Publication Data

US 2001/0026721 A1 Oct. 4, 2001

(30) Foreign Application Priority Data

Apr. 3, 2000 (JP) ..... 2000-101446

(51) Int. Cl.[7] ..... B41J 2/30

(52) U.S. Cl. ..... 400/124.02; 400/124.01; 400/124.04; 400/279

(58) Field of Search ..... 400/279, 124.01–124.05; 101/93.04, 93.05, 93.06

(56) References Cited

U.S. PATENT DOCUMENTS 4,208,137 A * 6/1980 Liu ..... 400/124.04
4,818,129 A * 4/1989 Tanuma et al. ..... 400/323
6,158,905 A * 12/2000 Endo ..... 400/76

FOREIGN PATENT DOCUMENTS

JP 53054424 A * 5/1978 ..... G06K/15/10
JP 59224366 A * 12/1984 ..... B41J/03/10
JP 62-92570 4/1987
JP 5-077445 3/1993
JP 5-155065 6/1993
JP 8-244282 9/1996

OTHER PUBLICATIONS

Japanese Office Action dated Sep. 3, 2002, with partial English translation.

* cited by examiner

*Primary Examiner*—Andrew H. Hirshfeld
*Assistant Examiner*—Minh H. Chu
(74) *Attorney, Agent, or Firm*—McGinn & Gibb, PLLC

(57) ABSTRACT

A control circuit generates two sorts of printing timing signals on the basis of the position of the printing mechanism module detected by a detector, and sends the generated signals to respective drive circuits. Herein, the printing mechanism module is configured of two printing element assemblies each of which includes a plurality of printing elements, and both of which are mechanically coupled. The two drive circuits taking charge of the two printing element assemblies send printing input signals to the respective printing elements which are to be driven according to the two sorts of printing timing signals received by the drive circuits. The relative positions between the print dots of the two printing element assemblies can be adjusted for each direction of printing on a sheet by changing the difference between the times of the two sorts of printing timing signals.

23 Claims, 5 Drawing Sheets

METHOD AND APPARATUS FOR ADJUSTING PRINT POSITIONS OF DOT LINE PRINTER

BACKGROUND OF THE INVENTION

The present invention relates to a method and an apparatus for adjusting the print positions of a dot line printer.

A method and an apparatus for adjusting the print positions of a dot line printer in the prior art will be described in detail with reference to the drawings.

FIG. 1 is a perspective view for explaining a first prior-art example (refer to, for example, Japanese Unexamined Patent Publication (JP-A) No. 244282/1996).

The dot line printer is constructed of a hammer bank 2 in which a large number of printing hammers 1 are arrayed in one row, a shuttle mechanism 8 which vibrates the hammer bank 2 laterally at a predetermined amplitude, a sheet feed mechanism 12, and so forth.

In the shuffle mechanism 8, the hammer bank 2 supported by right and left parallel flat springs 7 is connected to an eccentric cam 6 of a shuttle drive motor 5 through a connecting rod 4. When the shuttle drive motor 5 is rotated, the hammer bank 2 is vibrated in an approximate sinusoidal wave rightwards and leftwards. The sheet feed mechanism 12 is constituted by a platen 9 for transporting a printing sheet 13, and a sheet feed motor 11 for driving the platen 9 through a belt 10, thereby to transport the sheet 13 every dot line very exactly. While the hammer bank 2 is vibrated, the respective printing hammers 1 are operated to print dots at predetermined intervals, so that one row of dots is formed by the one-way operation (forward printing) Subsequently, when the hammer bank 2 is turned back (for reverse printing), the sheet 13 is transported the interval of one dot line, and the next dot line is printed. Further, the sheet 13 is transported one dot line immediately before forward printing. Characters are printed by repeating such operations. Incidentally, numeral 3 designates an inking ribbon.

FIG. 2 is a waveform diagram showing the printing timing signals of the prior-art dot line printer. A hammer bank leftmost-end signal 30 and a hammer bank rightmost-end signal 31 indicating the arrivals of the hammer bank 2 at the leftmost end and rightmost end thereof start a forward printing timing signal 32 for executing the forward printing and a reverse printing timing signal 33 for executing the reverse printing, respectively. Both the forward printing timing signal 32 and the reverse printing timing signal 33 are generated substantially at the time when hammer bank speed 36 is a set value. Since the printing is performed by reciprocally moving the hammer bank 2 by means of the shuttle mechanism 8, the printing of the identical printing hammer 1 must not allow a misalignment or shear between the lateral printing of the forward printing mode and that of the reverse printing mode. It is difficult, however, to avoid the lateral print shear of the identical printing hammer 1 between the forward and reverse printing modes merely by keeping the mechanical balance of the shuttle mechanism 8 which reciprocally moves the hammer bank 2. In the prior-art dot line printer, therefore, a reverse printing timing signal 35 as shown in FIG. 2 is generated after a delay of a time period after the transmission of the pulse of the hammer bank rightmost-end signal 31. The printing of the identical printing hammer 1 can be freed from the lateral print shear between in the forward printing mode and in the reverse printing mode by adjusting the time period t.

Besides, the line feed of the dot line of the sheet 13 is started by the final pulse of both the forward printing timing signal 34 and the reverse printing timing signal 35.

With the method for adjusting the print positions of the dot line printer in the first prior-art example, it is intended to compensate for the lateral print shear of the identical printing hammer 1 by shifting the reverse printing timing signal 35 in the reciprocal motion. On the other hand, the sheet line feed operation is started by the final pulse of both the forward printing timing signal 34 and the reverse printing timing signal 35, so that decrease or increase in the time period of the line feed is incurred. Accordingly, the sheet 13 does not cease moving before the start of the printing as shown by the sheet line feed speed 37 in FIG. 2, and hence, print dot positions become disordered to degrade print quality.

FIG. 3 is a waveform diagram showing a second prior-art example. Here in the second prior-art example, a dot line printer itself is supposed the same as shown in FIG. 1. A hammer bank leftmost-end signal 20 and a hammer bank rightmost-end signal 21 indicating the arrivals of the hammer bank 2 at the leftmost end and rightmost end thereof start a forward printing timing signal 22 for executing the forward printing and a reverse printing timing signal 23 for executing the reverse printing, respectively. Both the forward printing timing signal 22 and the reverse printing timing signal 23 are substantially generated at times when hammer bank speed 26 is a predetermined value.

Since the printing is performed by reciprocally moving the hammer bank 2 by means of the shuttle mechanism 8, in the printing of the identical printing hammer 1 shear or misalignment between the lateral print of the forward printing mode and that of the reverse printing mode is not allowable. It is difficult, however, to avoid the lateral print shear of the identical printing hammer 1 between in the forward printing mode and in the reverse printing mode merely by keeping the mechanical balance of the shuttle mechanism 8 which reciprocally moves the hammer bank 2.

Therefore, a forward printing timing signal 24 as shown in FIG. 3 is generated after a delay of a time period $t_1$ following generation of the pulse of the hammer bank leftmost-end signal 20.

Subsequently, a reverse printing timing signal 25 as shown in FIG. 3 is generated after a delay of a time period $t_2$ following generation of the pulse of the hammer bank rightmost-end signal 21. The printing of the identical printing hammer 1 can be freed from the lateral print shear between the forward printing mode and the reverse printing mode by adjusting the time periods $t_1$ and $t_2$.

The line feed of the dot line of the sheet 13 is started by the final pulse of both the forward printing timing signal 24 and the reverse printing timing signal 25. In this embodiment, the forward printing timing signal 24 and the reverse printing timing signal 25 are both adjusted by the predetermined adjustment time periods $t_1$ and $t_2$ relatively to the hammer bank leftmost-end signal 20 and the hammer bank rightmost-end signal 21, respectively. As shown by a sheet line feed speed 27 in FIG. 3, therefore, decrease or increase in the time period of the line feed is not incurred, to eliminate the drawback that the sheet 13 does not come to a stop before the start of the printing, causing print dot positions to become disordered to degrade print quality. Further, the adjustment can be facilitated more by equalizing the adjustment time periods $t_1$ and $t_2$.

With the method and apparatus for adjusting the print positions of the dot line printer in the second prior-art example, only one printing element assembly is concerned, and hence, the print shear can be avoided by adjusting the forward and reverse printing timing signals. However, in a case where a dot line printer includes a plurality of printing element assemblies and where the relative positions of the printing element assemblies in the extending direction thereof (in the line direction of a printing sheet) are not exactly in alignment, the relative positions of the print dots of the printing element assemblies cannot be corrected merely by the pair of printing timing signals in the forward and reverse modes.

Further, even in case of a known dot line printer whose printing mechanism module has a plurality of printing element assemblies, only one drive circuit is included, and only one printing timing signal is generated by a control circuit. Besides, while the printing element assemblies are mechanically coupled, the relative positions of these printing element assemblies in the extending direction thereof sometimes fail to meet designed values on account of discrepancy in the dimensions of the individual printing element assemblies. On this occasion, since only one printing timing signal is generated, the positions of installed printing elements are directly reflected on print dots formed, and the relative positions between the print dots in the extending direction (in the line direction of a printing sheet) fall outside designed values.

In a case where the relative positions between the print dots in the line direction misalign by a large amount due to the plurality of printing element assemblies, these assemblies must be mechanically regulated, and the magnitude of the regulation is a level of several tens $\mu$m. Accordingly, there have hitherto been the disadvantages that the regulation is difficult and that the number of the stages of the adjusting work enlarges.

SUMMARY OF THE INVENTION

It is therefore an object of the present invention to provide a method and an apparatus for adjusting the print positions of a dot line printer according to which the relative positions between print dots in the line direction of a printing sheet can be brought to appropriate relative positions without performing any mechanical regulation.

Another object of the present invention to provide a method and an apparatus for adjusting the print positions of a dot line printer according to which the number of the stages of adjusting work is small.

According to the present invention, in a dot line printer having a printing mechanism module which includes a plurality of printing element assemblies each having at least one printing element and which are mechanically coupled, and there is provided a method for adjusting print positions of the dot line printer characterized the adjustment steps of assigning drive circuits to the respective printing element assemblies, and generating a plurality of printing timing signals and individually sending them to said respective printing element assemblies by means of a control circuit, thereby to compensate a misalignment of relative positions between print dots of the printing element assemblies in opposing directions of printing, the misalignment being attendant upon a misalignment of relative positions between the printing element assemblies in opposing line directions.

Also, according to the present invention, in a dot line printer having a printing mechanism module which includes a plurality of printing element assemblies each having at least one printing element and which are mechanically coupled, there is provided an apparatus for adjusting print positions of the dot line printer, characterized by adjustment means for assigning drive circuits to the respective printing element assemblies, and generating a plurality of printing timing signals and individually sending them to the respective printing element assemblies by means of a control circuit, thereby to compensate a misalignment of relative positions between print dots of the printing element assemblies in opposing directions of printing, the misalignment being attendant upon a misalignment of relative positions between the printing element assemblies in opposing line directions.

Further, according to the present invention, in a dot line printer having a printing mechanism module which includes a plurality of printing element assemblies each having at least one printing element and which are mechanically coupled, there is provided an apparatus for adjusting print positions of the dot fine printer, characterized by comprising a detector which detects a position of the printing mechanism module, and a control circuit which generates two sorts of printing timing signals on the basis of an output signal of the detector.

DESCRIPTION OF THE PREFERRED EMBODIMENT;

In a dot line printer having a printing mechanism module which includes a plurality of printing element assemblies, the present invention is intended to avoid that misalignment of print dots in the line direction of a printing sheet which is ascribable to the misalignment of the relative positions of the printing element assemblies mechanically combined, and it consists of separately disposing drive circuits for the respective printing element assemblies and individually sending printing timing signals from a control circuit to the respective assemblies, thereby to adjust the print dot positions of the printing element assemblies.

Now, an embodiment of the present invention will be described in detail with reference to the drawings.

Figure 1:
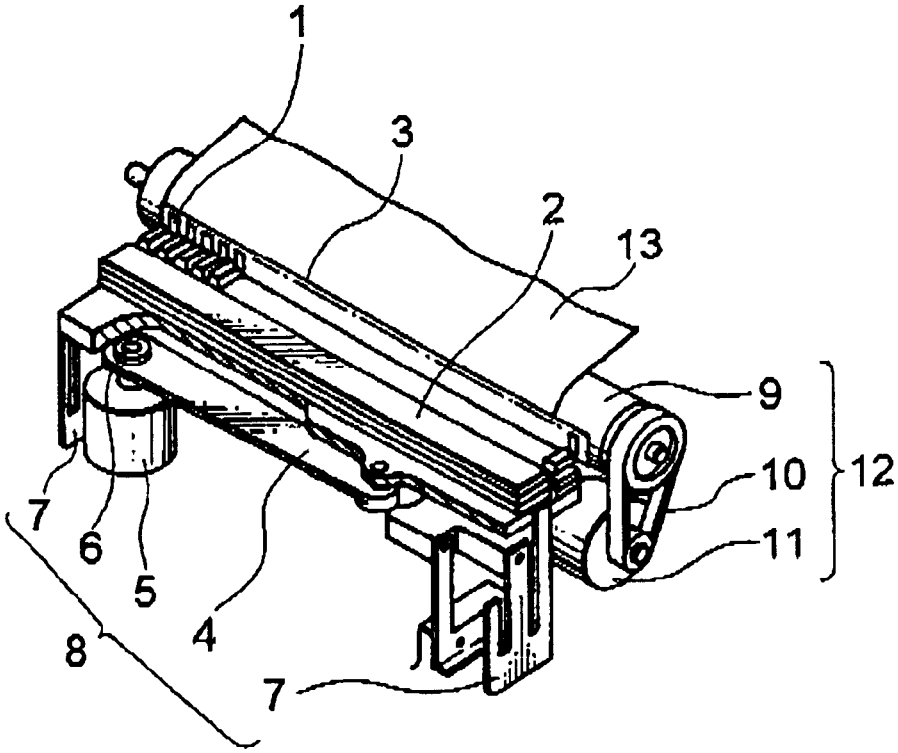
FIG. 1 PRIOR ART
FIG. 1 is a perspective view for explaining a method and an apparatus for adjusting the print positions of a dot line printer in a first prior-art example.
Figure 2:
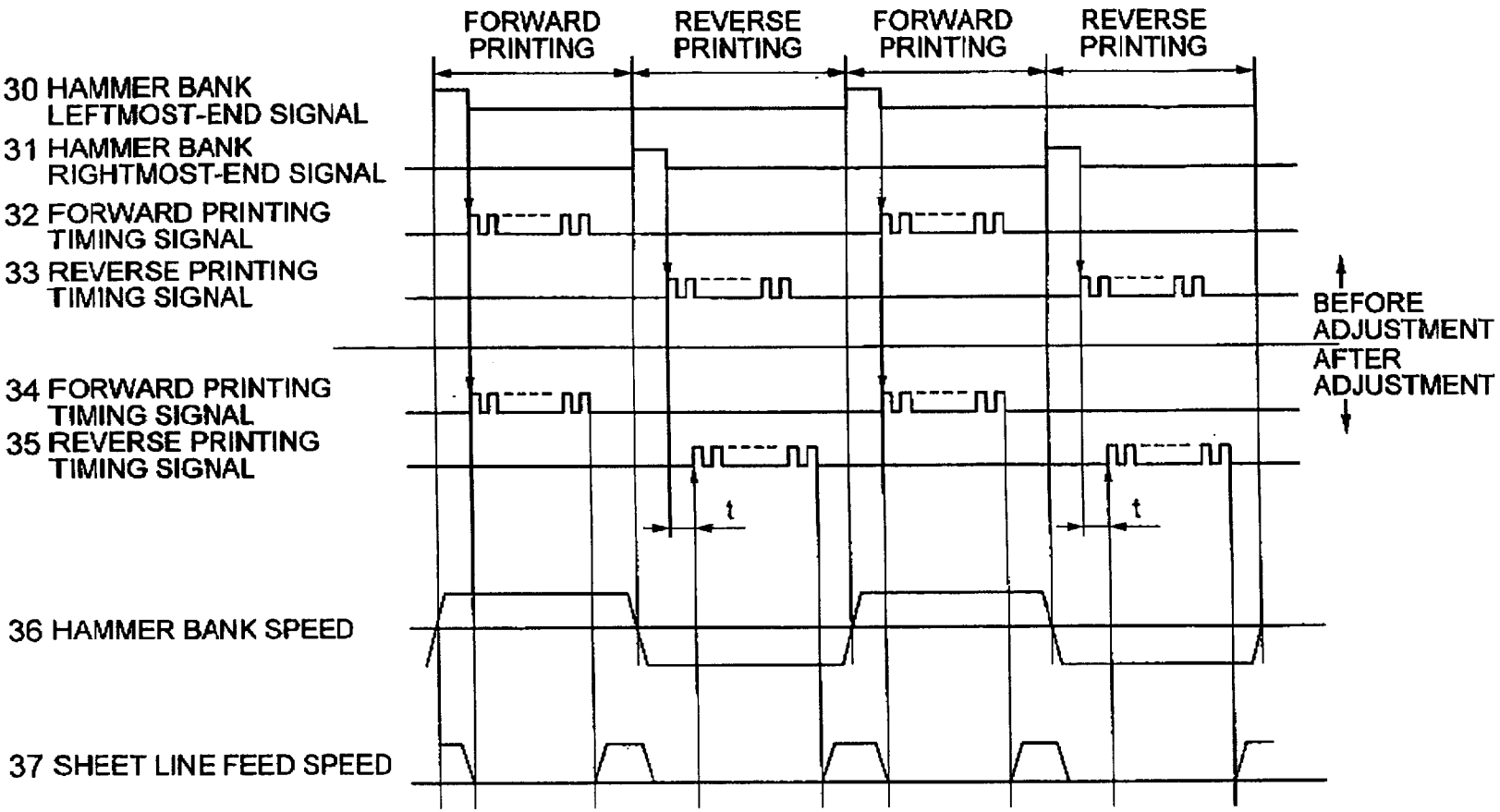
FIG. 2 PRIOR ART
FIG. 2 is a waveform diagram for explaining the operation of the method and apparatus shown in FIG. 1.
Figure 3:
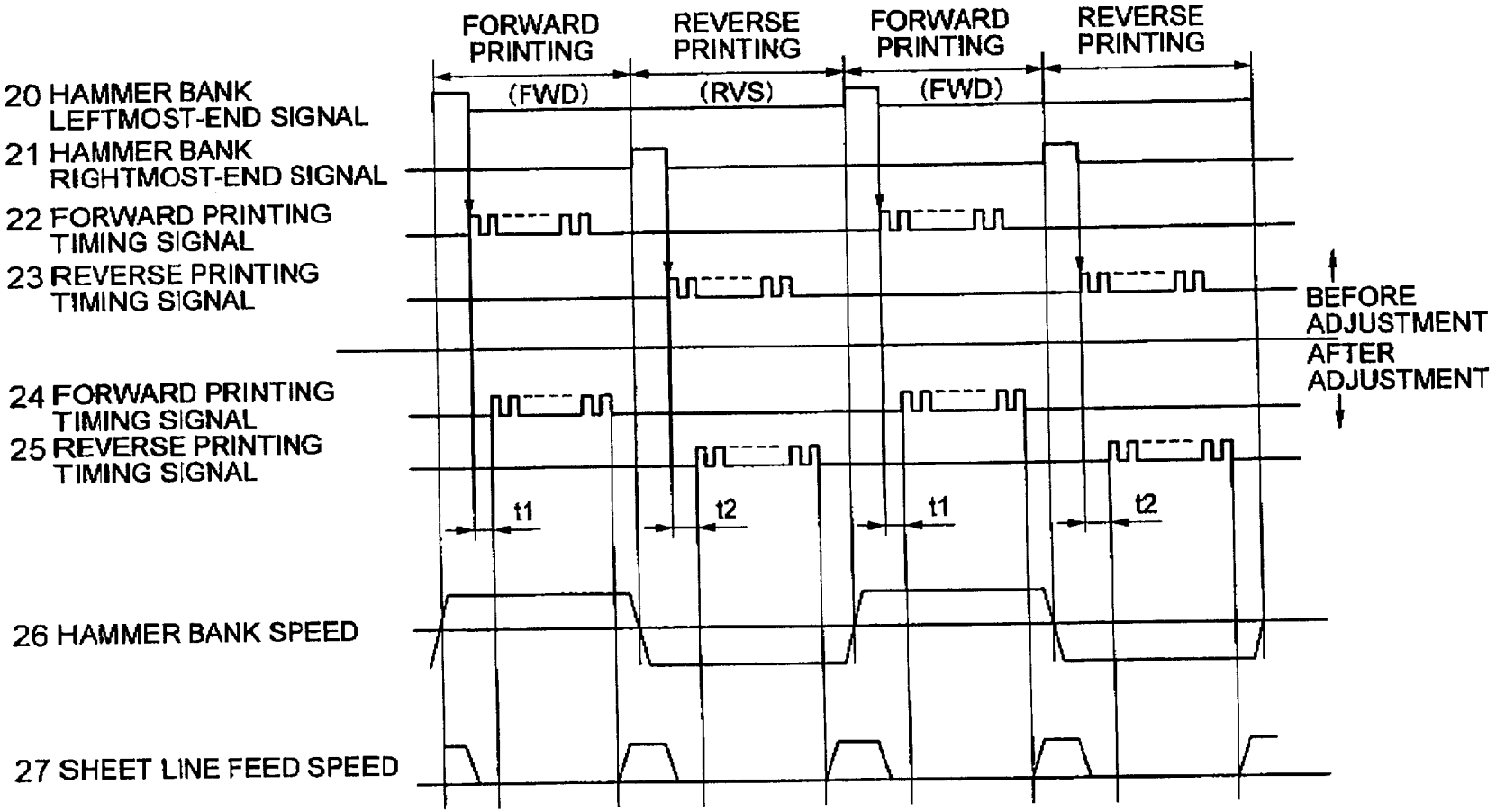
FIG. 3 PRIOR ART
FIG. 3 is a waveform diagram for explaining the operation of a method and an apparatus for adjusting the print positions of a dot line printer in a second prior-art example.
Figure 4:
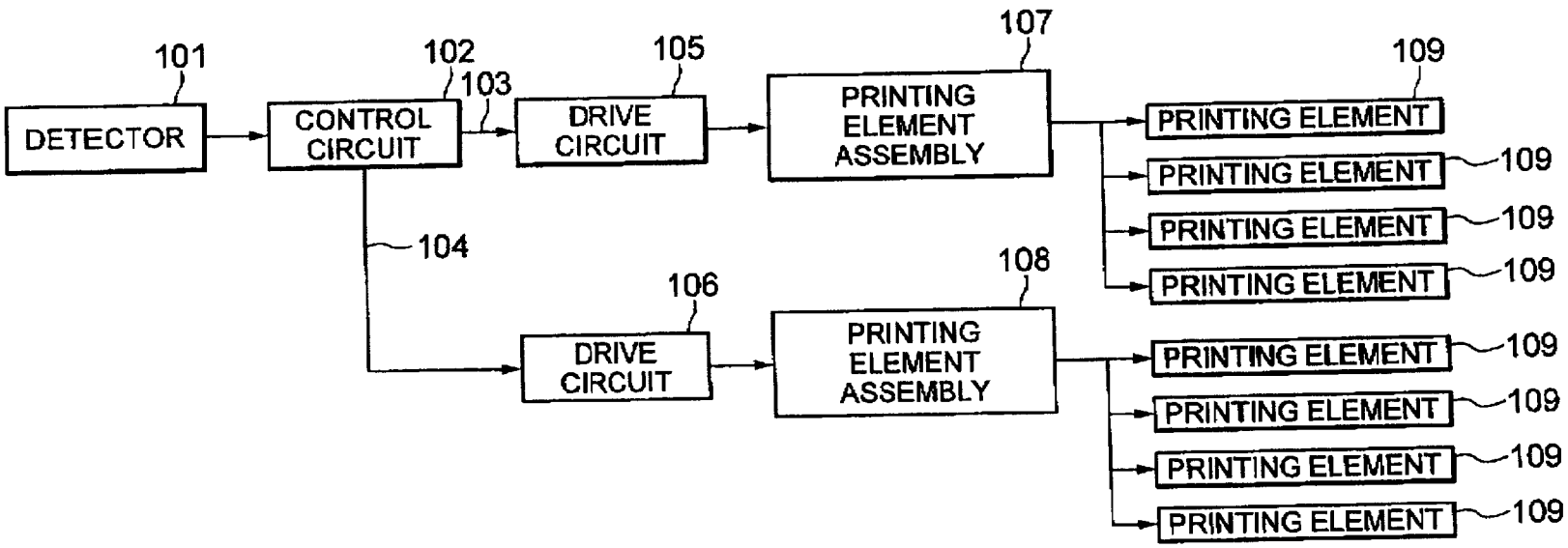
FIG. 4 is a block diagram showing a method and an apparatus for adjusting the print positions of a dot line printer in an embodiment of the present invention.

FIG. 4 is a block diagram showing one embodiment of the present invention. The embodiment concerns a dot line printer which includes, for example, two printing element assemblies 107, 108. A detector 101 detects the position of a printing mechanism module. A control circuit 102 generates two sorts of printing timing signals 103, 104 on the basis of the detected position, and the generated signals 103, 104 are respectively sent to drive circuits 105, 106. Herein, the printing mechanism module is configured of the two printing element assemblies 107 and 108 each of which has a plurality of printing elements 109, and both of which are mechanically coupled. The drive circuits 105, 106 taking charge of the printing element assemblies 107, 108 respectively supply the printing elements 109 to-be-driven with printing input signals on the basis of the received printing timing signals 103, 104, respectively. Accordingly, the relative positions between the print dots of the printing element assemblies 107, 108 can be adjusted in the line direction of a printing sheet by changing the difference between the times of the printing timing signals 103, 104.

Figure 5:
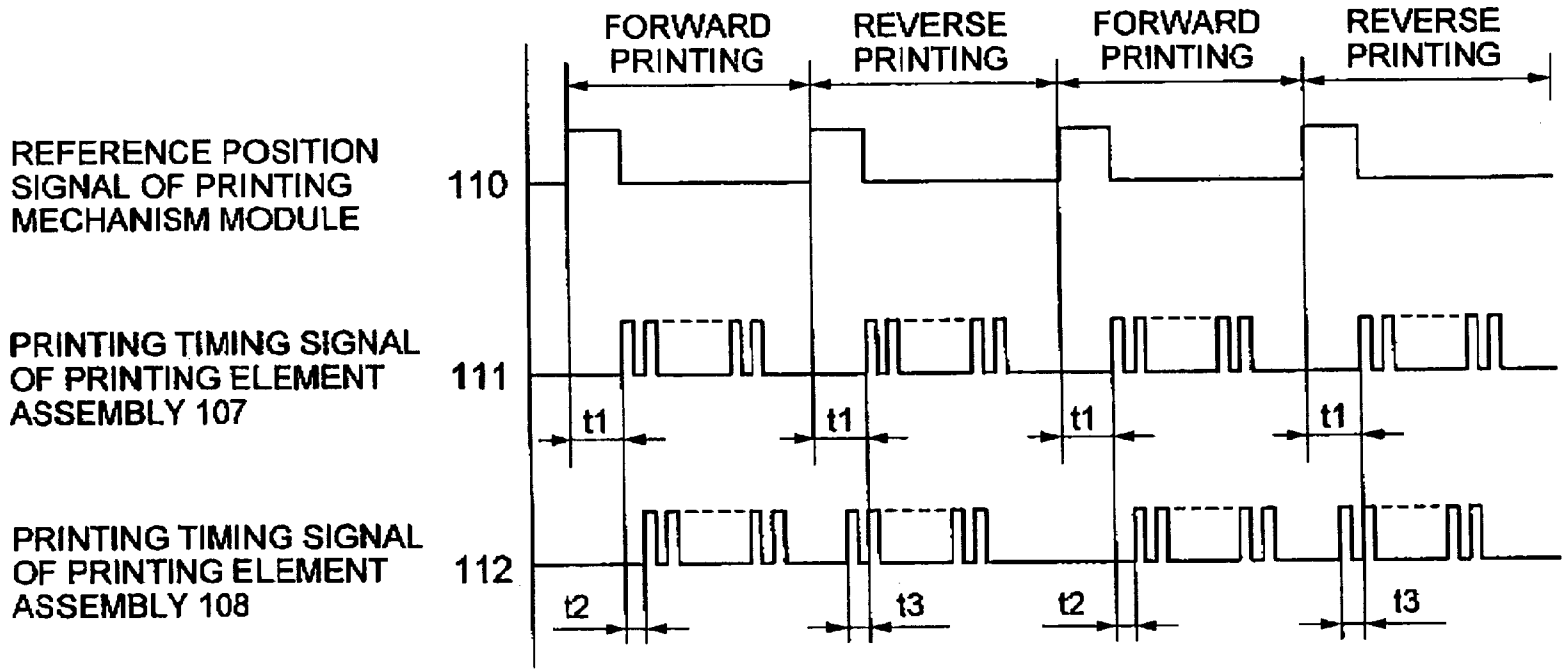
FIG. 5 is a waveform diagram for explaining the operation of the method and apparatus shown in FIG. 4.

FIG. 5 is a waveform diagram showing the printing timing signals for explaining the operation of the embodiment of the present invention. When the printing mechanism module has arrived at a predetermined position during its horizontal reciprocating rectilinear motion due to a shuttle mechanism module, the sensor 101 detects the arrival and generates a reference position signal 110. The printing timing signal 111 of the printing element assembly 107 is generated after a predetermined time period $t_1$ on the basis of the reference position signal 110.

Subsequently, in a case where the dot position of the printing element assembly 108 is to be shifted in, for example, a forward printing direction relatively to that of the printing element assembly 107, the printing timing signal 112 of the printing element assembly 108 is generated with the delay of a time period $t_2$ in the forward printing mode thereof. The time period $t_2$ is determined from the moving speed and dot pitch deviation amount of the printing mechanism module.

In the reverse printing mode of the printing element assembly 108, the generation of the printing timing signal 112 is advanced a time period $t_3$ equal to the time period $t_2$, relatively to that of the printing timing signal 111 contrariwise to the operating aspect in the forward printing mode. The print dot positions of the printing element assembly 108 can be adjusted as required by controlling the time periods $t_2$, $t_3$.

With the method and apparatus of the present invention for adjusting the print positions of a dot line printer, the optimum print positions can be attained by adding the procedure or means for adjusting the relative positions between the printed dots in lines facing each other, without performing any mechanical regulation. Moreover, the number of the stages of an adjusting work can be decreased.

What is claimed is:

1. A method for adjusting print positions of a dot line printer having a printing mechanism module which includes a plurality of printing element assemblies, each of said plurality of printing element assemblies have at least one printing element, wherein said plurality of printing element assemblies are mechanically coupled comprising:

assigning a drive circuit to each of the plurality of printing element assemblies;

generating a plurality of printing timing signals; and individually sending the plurality of printing timing signals to said respective plurality of printing element assemblies by means of a control circuit to compensate for a misalignment of relative positions between print dots of said plurality of printing element assemblies in opposing directions of printing, the misalignment resulting from a misalignment of relative positions between said plurality of printing element assemblies in opposing line directions.

2. The method of claim 1, wherein said plurality of printing timing signals compensates for the relative positions between the print dots of said plurality of printing element assemblies for each line direction of printing based upon the difference between the timing of said plurality of printing timing signals.

3. The method of claim 2, further comprising adjusting the relative positions between the print dots of said plurality of printing element assemblies for each line direction of printing by adjusting the difference between the timing of said plurality of printing timing signals.

4. A dot line printer having a printing mechanism module comprising:

a plurality of printing element assemblies, wherein each of said plurality of printing element assemblies have at least one printing element, and wherein said plurality of printing element assemblies are mechanically coupled;

an apparatus for adjusting print positions of the dot line printer comprising:

adjustment means for assigning a drive circuit to each of the plurality of printing element assemblies, and for generating a plurality of printing timing signals; and a control circuit for individually sending the plurality of printing timing signals to said respective plurality of printing element assemblies to compensate for a misalignment of relative positions between print dots of said plurality of printing element assemblies in opposing directions of printing, the misalignment being attendant upon a misalignment of relative positions between said plurality of printing element assemblies in opposing line directions.

5. A dot line printer having a printing mechanism module comprising:

a plurality of printing element assemblies which each have at least one printing element, and wherein said plurality of printing element assemblies are mechanically coupled;

a detector which detects a position of the printing mechanism module; and a control circuit controlling a drive circuit for each of the plurality of printing element assemblies which generates two sorts of printing timing signals on the basis of an output signal of said detector, wherein a first of said two sorts of printing timing signals comprises a timing signal for each of said plurality of printing element assemblies for a first output signal from said detector and a second of said two sorts of printing timing signals comprises a timing signal for each of said plurality of printing element assemblies for a second output signal from said detector and wherein first and second sorts of printing timing signals are different.

6. The apparatus of claim 5, wherein each of said plurality of printing element assemblies are mechanically coupled.

7. The apparatus of claim 5, further comprising a drive circuit for each of the respective plurality of printing element assemblies which send printing input signals to the printing elements of corresponding ones of said plurality of printing element assemblies according to printing timing signals received by said drive circuit.

8. The printer of claim 5, wherein said plurality of printing element assemblies comprise a plurality of hammer banks.

9. A method for adjusting print positions of a dot line printer having a plurality of printing element assemblies, each of the plurality of printing assemblies having a printing element, wherein said plurality of printing element assemblies are mechanically coupled, comprising:

generating a plurality of printing timing signals from a corresponding plurality of drive circuits, wherein each of said plurality of drive circuits generates one of said plurality of printing timing signals for a corresponding one of said plurality of printing element assemblies; and sending the plurality of printing timing signals to said plurality of printing element assemblies, wherein a control circuit controls said plurality of drive circuits so that said plurality of timing signals compensates for a misalignment of relative positions between print dots of said plurality of printing element assemblies in opposing directions of printing.

10. The method of claim 9, wherein said misalignment results from a misalignment of relative positions between said plurality of printing element assemblies in opposing line directions.

11. The method of claim 9, wherein said plurality of timing signals compensates for said misalignment by controlling the timing between said plurality of timing signals relative to a reference position signal.

12. The method of claim 9, further comprising adjusting the timing of said plurality of timing signals relative to a reference position signal.

13. The method of claim 9, wherein the timing of a first of said timing signals for a first of said plurality of said printing element assemblies relative to reference position signal is different in a forward printing direction than the timing of a second of said timing signals for a second of said plurality of said printing element assemblies relative to said reference position signal in said forward printing direction.

14. The method of claim 13, wherein the timing of said second timing signals relative to a reference position signal in a forward printing direction is different than the timing of said second timing signals relative to a reference position signal in a reverse printing direction.

15. The method of claim 14, wherein the timing of said second timing signals relative to a reference position signal in a forward direction is delayed relative to the timing of said first timing signals relative to said reference position signal in said forward direction.

16. The method of claim 14, wherein the timing of said second timing signals relative to a reference position signal in a reverse direction is delayed relative to the timing of said first timing signals relative to said reference position signal in said forward direction.

17. The method of claim 9, wherein the timing of a first of said timing signals for a first of said plurality of said printing element assemblies relative to reference position signal is different in a reverse printing direction than the timing of a second of said timing signals for a second of said plurality of said printing element assemblies relative to said reference position signal in said reverse printing direction.

18. The method of claim 17, wherein the timing of said second timing signals relative to a reference position signal in a forward printing direction is different than the timing of said second timing signals relative to a reference position signal in a reverse printing direction.

19. The method of claim 18, wherein the timing of said second timing signals relative to a reference position signal in a forward direction is delayed relative to the timing of said first timing signals relative to said reference position signal in said forward direction.

20. The method of claim 18, wherein the timing of said second timing signals relative to a reference position signal in a reverse direction is delayed relative to the timing of said first timing signals relative to said reference position signal in said forward direction.

21. A dot line printer comprising:

a plurality of printing element assemblies mechanically coupled to each other and which each have at least one printing element;

a detector which detects a position of the printing mechanism module and generates a first reference position signal in a forward printing direction and a second reference position signal in a reverse printing direction;

a drive circuit for each of said plurality of printing element assemblies which generates a printing timing signal for each of said corresponding plurality of printing element assemblies; and a control circuit which controls each of said drive circuits so that a first printing timing signal for a first of said plurality of printing element assemblies has a different timing than a second printing timing signal for a second of said plurality of plurality of printing element assemblies relative to both of said first reference position signal and said second reference position signal.

22. The printer of claim 21, wherein the timing of said second printing timing signal is delayed relative to said first printing timing signal in said forward printing direction.

23. The printer of claim 21, wherein the timing of said second printing timing signal is advanced relative to said first printing timing signal in said reverse printing direction.

* * * * *